United States Patent [19]

Beitz et al.

[11] Patent Number: 4,852,824

[45] Date of Patent: Aug. 1, 1989

[54] CREEL

[75] Inventors: Jurgen Beitz, Neumunster; Karl-Heinz Erren, Aukrug-Homfeld; Ekkehard Mantz, Grob-Kummerfeld, all of Fed. Rep. of Germany

[73] Assignee: Norddeutsche Faserwerke GMBH, Neumunster, Fed. Rep. of Germany

[21] Appl. No.: 95,436

[22] Filed: Sep. 3, 1987

[30] Foreign Application Priority Data

Sep. 3, 1986 [DE] Fed. Rep. of Germany ..... 3629927

[51] Int. Cl.[4] ..... B65H 49/14

[52] U.S. Cl. ..... 242/131.1

[58] Field of Search ..... 242/131.1, 131; 28/190, 28/193

[56] References Cited

U.S. PATENT DOCUMENTS

| | | | |
|---|---|---|---|
| 1,824,356 | 9/1931 | Marcroft et al. | 242/131.1 |
| 2,050,775 | 8/1936 | Alderman | 242/131.1 X |
| 2,177,855 | 10/1939 | Balch et al. | 242/131 |
| 2,259,079 | 10/1941 | Reiners et al. | 242/131.1 |
| 2,325,974 | 8/1943 | Pasquerello | 242/131.1 |
| 3,875,883 | 4/1975 | Eberwein et al. | 242/131.1 X |
| 4,498,644 | 2/1985 | Kupper et al. | 242/131.1 |
| 4,538,776 | 9/1985 | Perry | 242/131 |
| 4,552,321 | 11/1985 | Raeckelboom | 242/130 |
| 4,572,458 | 2/1986 | Bluhm et al. | 242/131 |

FOREIGN PATENT DOCUMENTS

| | | | |
|---|---|---|---|
| 685482 | 12/1939 | Fed. Rep. of Germany . | |
| 1039450 | 9/1958 | Fed. Rep. of Germany . | |
| 2344906 | 11/1974 | Fed. Rep. of Germany . | |
| 2360507 | 6/1975 | Fed. Rep. of Germany . | |
| 3128933 | 3/1983 | Fed. Rep. of Germany . | |
| 3211924 | 10/1983 | Fed. Rep. of Germany . | |
| 3429153 | 2/1985 | Fed. Rep. of Germany | 242/131 |
| 8428057 | 5/1985 | Fed. Rep. of Germany . | |
| 670535 | 4/1952 | United Kingdom . | |
| 1370915 | 10/1974 | United Kingdom | 242/131 |

*Primary Examiner*—Stanley N. Gilreath

*Attorney, Agent, or Firm*—Oblon, Spivak, McClelland, Maier & Neustadt

[57] ABSTRACT

A warping creel with bobbins of threads to be warped arranged side-by-side and one-above-the-other having swing-out creel gates 9 carrying thread guides 14, 14', 14'' which provide access to the individual bobbins 10. Guiding elements 12 for each thread 4 guide the threads 4 to the warping machine 6 initially vertically over the creel, than horizontally above the creel.

12 Claims, 4 Drawing Sheets

CREEL

FIELD OF THE INVENTION

The present invention is concerned with creels in which the bobbins of the threads to be warped are arranged side by side and one above the other. It allows for constant accessibility of each bobbin, even during warping.

GENERAL DISCUSSION OF THE INVENTION

To this end, the invention provides swing-out creel gates carrying thread guides. Behind the creel gates are situated the rolls of thread to be warped, which become accessible through the swinging out of the creel gates. In addition, the creel according to the invention has thread guiding units which initially guide each thread vertically or approximately vertically over the creel, and there reroute the threads into the horizontal direction and guide them to the warping machine. By virtue of these measures, each bobbin is accessible also during warping and can simply be replaced (e.g., in the event of thread faults).

To ensure that the frictional resistance will be approximately the same for all threads, the guides and guiding units of all threads are preferably provided with the same direction changing devices. For example, each thread pulled off the bobbin approximately horizontally can be guided by thread guides about 90° into the vertical. The now vertically rising thread is guided by a direction changing device about 90° into a horizontal direction leading to the center gangway. At the center gangway, a further rerouting by about 90° takes place, now in the direction of the warping machine. Each thread thus experiences three times a change of direction by about 90°.

To guide the threads over the creel and above the creel, guide units of the usual type can be used (e.g. combs or eyes). The use of guide tubes as guide units is preferred. They protect the thread against contamination and against damage (for example, while the warping mill is at standstill).

It has proved appropriate to connect in an airtight manner the various straight parts of the guide tubes by means of pipes of plastic material, which appropriately are bent according to the rerouting angle and are slid onto the straight tube parts. These plug connections of plastic material by the airtight closure permit the intake of the threads by means of customary injectors.

To equalize the differences in frictional resistance, which occur due to the different lengths of the guide tubes between creel and warping machine, an eyelet brake can be provided for each thread. By shifting this eyelet brake perpendicularly to the direction of the thread's course, different frictional resistances can be produced, which equalize the differences of the length-dependent friction in the tubes. These eyelet brakes can also be adjustable jointly for a group of threads passing through guide tubes of approximately the same length.

The creel can also comprise a clamping brake for each thread. The clamping brake is preferably a disk brake. When the warping machine is stopped or running at slow speed, the tension in the thread is to be maintained with these brakes. While the warping machine is running at high speed, the brake is open, which prevents additional tension on the thread. In order to have the braking effect of the disk brake available speedily at the start and stop of the warping machine, disk brakes which open or close the brake by gas pressure against spring tension have proved particularly suitable.

The aforementioned measures, especially the guiding of all threads over the creel, make possible a space-saving setup of the creel even when a large number of threads is to be warped. According to a preferred embodiment of the invention, the bobbins arranged side-by-side and one above the other are placed in rows which are separated from one another by gangways. Creel posts and gates can be arranged at both sides of the gangways, so that two rows of bobbins can be serviced from one gangway.

It was furthermore found to be appropriate to hang the bobbins on creel carriages that are accessible from both sides and to utilize the space between the gangways as parking spaces for the creel carriages. Thus, while the threads of one set of bobbins are being warped, the warping carriages can already be supplied while the bobbins of the next set while outside the creel. In this manner, the stop periods of the creel to replace the sets of bobbins are considerably reduced.

An advantageous arrangement of the creel is obtained by having the rows of bobbins and associated creel posts and gates that are arranged side-by-side and one above the other on both sides of a center gangway leading to the warping machine arranged vertically to the center gangway. When warping carriages are used, the width of the center gangway is preferably such that it corresponds to at least the diagonal length of one warping carriage. The rows of creels on both sides can thereby be supplied from the center gangway.

The arrangement of the creel according to the invention makes possible, for example, the simultaneously warping of 1280 threads with a bobbin diameter of 450 mm of an area of 180 $m^2$. An area of less than 400 $m^2$ is sufficient for even 2.5 times that number of threads.

DETAILED DESCRIPTION OF THE PRESENTLY PREFERRED EMBODIMENT

Figure 1:
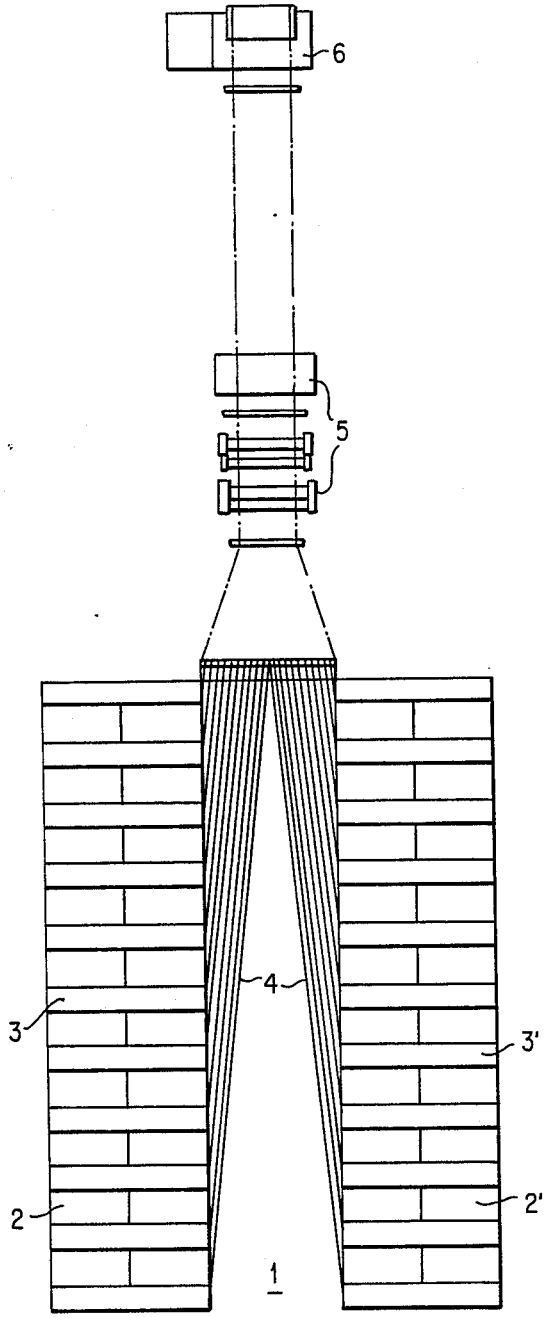
FIG. 1 is a plan view showing the arrangement of a creel according to the invention.

FIG. 1 shows the arrangement of a creel with parking spaces 2 and 2' for 40 creel carriages in 10 rows of 2 carriages each on both sides of a center gangway 1. If double sided creel carriages provided with 16 bobbins per side are used, 1280 threads can be warped.

Another possibility is the arrangement of 3 such creel carriages in one row, whereby, with 16 rows on each side of the center gangway 1 and creel carriages of the type described, 3072 threads can be warped simultaneously. The same number can also be attained with 12 rows each on both sides of the center gangway 1 and 4 creel carriages in one row. It is also possible to serve with this creel several warping machines at the same time.

The gangways 3 and 3' are situated between the parking spaces 2 and 2' for the creel carriages. The creel carriages inserted through the center gangway 1 as well as the guiding devices, such as eyelet and locking brakes, are accessible from the gangways 3,3'.

The threads leading horizontally from the creel to the warping machine are indicated by the numeral 4. For a clearer view, only every 4th group of threads is shown. The outlined creel, using the aforementioned creel carriages provided with 16 bobbins on each side, has a total of 80 groups, each having 16 threads guided one above the other.

A warping machine is indicated by the numeral 6. The numeral 5 indicates the component control and auxiliary equipment, such as fluff detectors, thread storage, and an oil unit.

Figure 2:
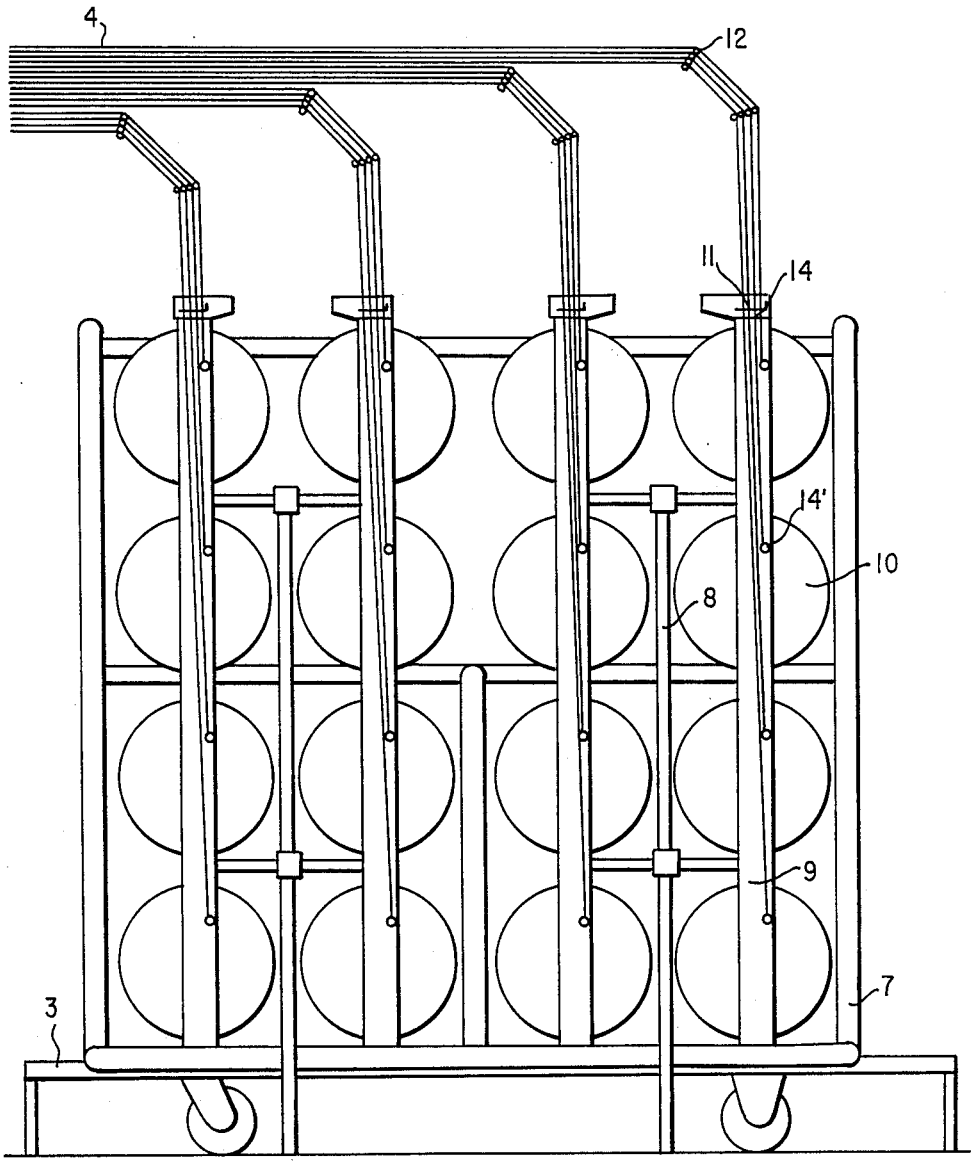
FIG. 2 is a front elevation showing a part of the creel with a creel carriage inserted.

FIG. 2 shows a part on the creel a with creel carriage 7 inserted, seen in the warp direction. The creel consists of creel posts 8 to which swinging creel gates 9 are attached. The swivel feature of creel gates 9 permits access to the individual bobbins 10 and, for example, the replacing of a bobbin, if the thread on it is defective. From the creel gates 9, the threads 4 are initially guided approximately vertically upwards and after their direction is changed twice by 45° each time, run horizontally to the center gangway.

Figure 3:
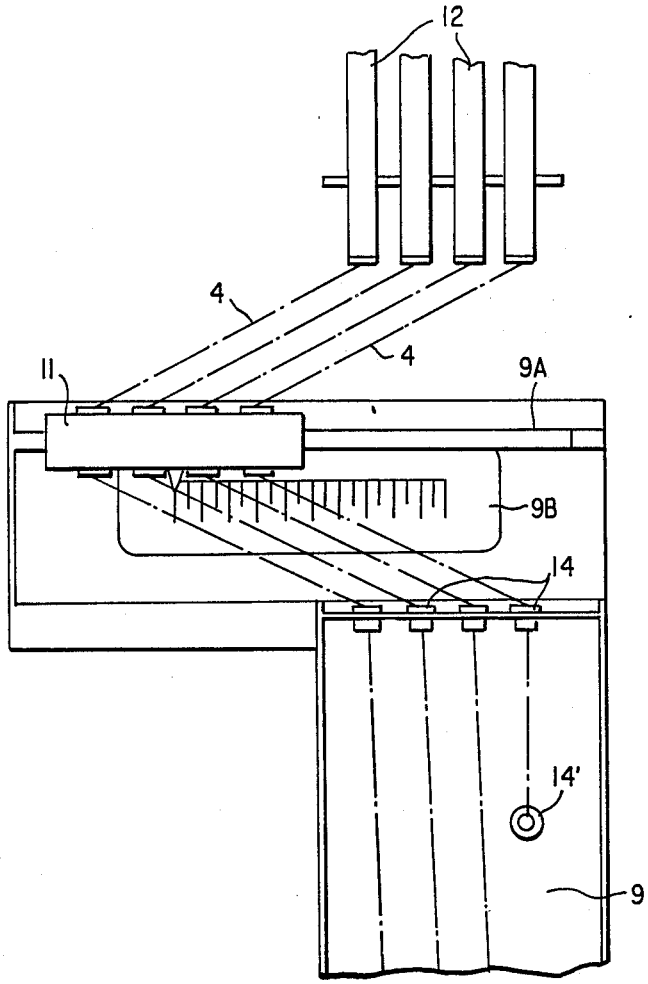
FIG. 3 is an enlarged view of a portion of the upper part of a creel gate shown in FIG. 2.

FIG. 3 shows the upper part of a creel gate 9. The direction of the threads 4 is changed 90° by the thread guide eyelets 14'. Next, moving vertically upwards, the threads 4 reach the thread guides 14, which are also attached to the creel gate 9. Above them, the eyelet brakes 11 are arranged on a movable carriage. The extent of the braking force exerted by the eyelet brakes 11 is determined by moving the carriage transverse to the direction of feed of the threads (i.e., horizontally) and thus by the size of the angles by which the threads are deflected from the straight forward motion. Guide tubes 12 serve as thread guides to guide the threads upwards. The movable carriers for the brakes 11 are supported by the creel gate 9 via the guide 9A. The position of the carriage is determined with reference to the scale 9B.

Figure 4:
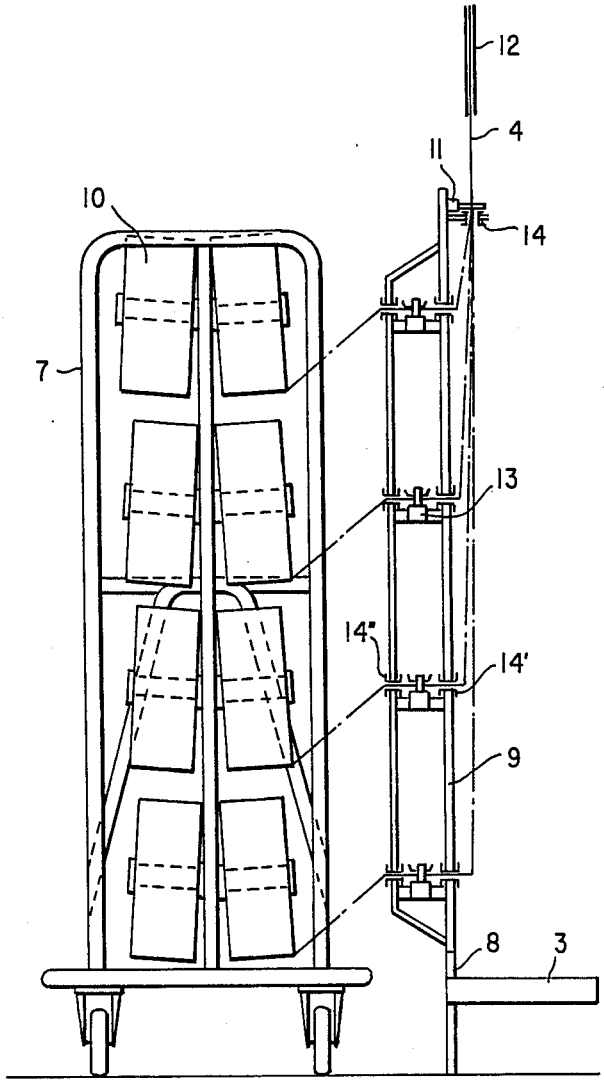
FIG. 4 is a side elevation showing a creel with an inserted creel carriage.

FIG. 4 shows the creel with an inserted creel carriage 7, seen perpendicular to the center gangway 1. The creel carriage 7 is provided with bobbins 10 on both its sides, while the creel elements are shown on only one side of the carriage 7 and the gangway 3, respectively. The threads 4 are guided upwards by the thread guides 14'', clamping brakes 13, thread guides 14' and 14, as well as eyelet brake 11, and there, as described in connection with FIG. 2, they are guided in a direction horizontal to the center gangway and to the warping machine 6.

We claim:

1. A warping creel comprising (a) a plurality of creel carriages;

(b) a plurality of bobbins arranged side-by-side and one-above-the-other in each one of said plurality of creel carriages;

(c) a plurality of creel posts;

(d) a plurality of swing-out creel gates mounted on each one of said plurality of creel posts, each one of said plurality of swingout creel gates providing access to associated ones of said plurality of bobbins;

(e) a plurality of thread guides mounted on each one of said plurality of swing-out creel gates, each one of said plurality of thread guides being associated with a corresponding one of said plurality of bobbins; and (f) means for guiding threads from each one of said plurality of thread guides, first vertically upwards and then horizontally above the associated one of said plurality of creel carriages.

2. A warping creel as recited in claim 1 wherein each one of said plurality of thread guides and the associated one of said means cause equal changes in direction of the associated thread.

3. A warping creel as recited in claim 1 wherein said guiding means comprises a plurality of guide tubes.

4. A warping creel as recited in claim 3 wherein each said guide tube comprises plural tubes formed of plastic, connected together in an air tight fashion.

5. A warping creel as recited in claim 1 and further comprising an eyelet brake for each thread.

6. A warping creel as recited in claim 1 and further comprising a clamping brake for each thread.

7. A warping creel as recited in claim 6 wherein at least some of said clamping brakes are disk brakes.

8. A warping creel as recited in claim 7 wherein said at least some of said disk brakes are clamped pneumatically against spring tension.

9. A warping creel as recited in claim 1 wherein:

(a) said plurality of creel carriages are arranged in rows and (b) each two adjacent ones of said rows are separated by a gangway.

10. A warping creel as recited in claim 9 wherein said gangways can serve as parking spaces for at least some of said plurality of creel carriages.

11. A warping creel as recited in claim 9 wherein said gangeways are arranged verically to a ceter gangway and on both sides of said center gangway.

12. A warping creel as recited in claim 11 wherein:

(a) said plurality of creel carriages all have the same diagonal length and (b) said center gangway is at least as wide as the diagonal length of said plurality of creel carriages.

* * * * *